US005451331A

United States Patent [19]

O'Connor et al.

[11] Patent Number: 5,451,331

[45] Date of Patent: * Sep. 19, 1995

[54] PROCESS FOR THE PRODUCTION OF A LUBRICATING OIL ADDITIVE CONCENTRATE

[75] Inventors: Sean P. O'Connor, Hull; John Crawford, Caterham; Charles Cane, Hull, all of England

[73] Assignee: BP Chemicals (Additives) Limited, London, England

[ * ] Notice: The portion of the term of this patent subsequent to Nov. 10, 2009 has been disclaimed.

[21] Appl. No.: 207,222

[22] Filed: Mar. 4, 1994

Related U.S. Application Data

[63] Continuation of Ser. No. 964,519, Oct. 21, 1992, abandoned, which is a continuation of Ser. No. 363,635, Jun. 8, 1989, abandoned.

[30] Foreign Application Priority Data

Jun. 14, 1988 [GB] United Kingdom ..... 8814008

[51] Int. Cl.[6] ..... C10M 159/20

[52] U.S. Cl. ..... 252/18; 252/39

[58] Field of Search ..... 252/18, 39

[56] References Cited

U.S. PATENT DOCUMENTS

| | | | |
|---|---|---|---|
| 3,410,798 | 11/1968 | Cohen | 252/32.7 |
| 3,629,109 | 12/1971 | Gergel et al. . | |
| 4,869,837 | 9/1989 | van Wijngaarden et al. | 252/39 |
| 5,162,085 | 11/1992 | Cane et al. | 252/18 |

FOREIGN PATENT DOCUMENTS

| | | | |
|---|---|---|---|
| 0208750 | 10/1956 | Australia | 252/39 |
| 0094814 | 11/1983 | European Pat. Off. . | |
| 2033736 | 12/1970 | France . | |
| 759346 | 10/1956 | United Kingdom . | |
| 1146925 | 3/1969 | United Kingdom | 252/39 |
| 1198357 | 7/1970 | United Kingdom . | |
| 8803944 | 6/1988 | WIPO . | |
| 8803945 | 6/1988 | WIPO . | |

*Primary Examiner*—Jerry D. Johnson

*Attorney, Agent, or Firm*—Brooks Haidt Haffner & Delahunty

[57] ABSTRACT

A process for the production of a lubricating oil additive concentrate having a TBN greater than 300 comprises reacting at elevated temperature component (A) a defined salicylic acid derivative, component (B) an alkaline earth metal base added either in a single addition or in a plurality of additions at internediate points during the reaction, component (C) at least one compound which is (i) water, (ii) a polyhydric alcohol having 2 to 4 carbon atoms, (iii) a di- ($C_3$ or $C_4$) glycol, (iv) a tri-($C_2$–$C_4$) glycol, (iv) a mono- or poly-alkylene glycol alkyl ether of the formula (I)

$$R(OR^1)_xOR^2 \quad (I)$$

wherein R is a $C_1$ to $C_6$ alkyl group, $R^1$ is an alkylene group $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ether, component (D) a lubricating oil, component (E) carbon dioxide added subsequent to the, or each, addition of component (B), component (F) a defined carboxylic acid or derivative, and component (G) at least one compound which is (i) an inorganic halide of (ii) an ammonium alkanoate or mono-, di-, tri- or tetra-alkyl ammonium formate or alkanoate provided that, when component (G) is (ii), component (F) is not an acid chloride, the weight ratios of all components being such as to produce a concentrate having a TBN greater than 300.

9 Claims, No Drawings

PROCESS FOR THE PRODUCTION OF A LUBRICATING OIL ADDITIVE CONCENTRATE

This application is a continuation, of application Ser. No. 07/964,519, filed Oct. 21, 1992 now abandoned, which is a continuation of Ser. No. 07/367,635 filed Jun. 8, 1989, now abandoned.

The present invention relates to a process for the production of, and compositions comprising, a lubricating oil additive concentrate containing alkaline earth metal hydrocarbyl-substituted salicylates and their sulphurised derivatives.

In the internal combustion engine, by-products from the combustion chamber often blow by the piston and admix with the lubricating oil. Many of these by-products form acidic materials within the lubricating oil.

One class of compounds generally employed to neutralise the acidic materials and disperse sludge within the lubricating oil are the metal hydrocarbyl-substituted salicylates and sulphurised metal hydrocarbyl-substituted salicylates, wherein the metal is an alkaline earth metal such as calcium, magnesium or barium. Both "normal" and "overbased" alkaline earth metal hydrocarbyl-substituted salicylates have been employed. The term "overbased" is used to describe those alkaline earth metal hydrocarbyl-substituted salicylates in which the ratio of the number of equivalents of the alkaline earth metal moiety to the number of equivalents of the salicylate moiety is greater than one, and is usually greater than 1.2 and may be as high as 4.5 or greater. In contrast, the equivalent ratio of alkaline earth metal moiety to salicylate moiety in "normal" alkaline earth metal hydrocarbyl-substituted salicylates is one. Thus, the "overbased" material usually contains greater than 20% in excess of the alkaline earth metal than present in the corresponding "normal" material. For this reason "overbased" alkaline earth metal hydrocarbyl-substituted salicylates have a greater capability for neutralising acidic matter than do the corresponding "normal" alkaline earth metal hydrocarbyl substituted salicylates.

The prior art teaches many methods for preparing both "normal" and "overbased" metal hydrocarbyl-substituted salicylates.

The use of carboxylic acids in the production of alkaline earth metal hydrocarbyl-substituted salicylates and their sulphurised derivatives is not new, see for example GB-A-1,198,357.

GB-A-1,198,357 discloses a method for preparing a basic metal salicylate which comprises reacting, between 25° C. and the reflux temperature, (A) a hydrocarbyl-substituted salicylic acid having at least 6 carbon atoms in the substituent, a mixture of said salicylic acid with up to an equivalent amount of a hydrocarbyl-substituted succinic acid or anhydride having at least 6 carbon atoms in the substituent, or a substantially neutral alkali metal or alkaline earth metal salt of either of the foregoing, (B) 1–10 equivalents per equivalent of (A) of a calcium or strontium base, and (C) carbon dioxide, in the presence of 0.002–0.2 equivalents per equivalent of said calcium or strontium base, of a carboxylic acid having up to 100 carbon atoms or an alkali metal, alkaline earth metal, zinc or lead salt thereof. Preferred carboxylic acids are said to be those containing up to 10 carbon atoms, of which acetic acid is specifically mentioned. The only carboxylic acid exemplified is acetic acid.

The prior art in which carboxylic acids are employed does not address the problem of producing additive concentrates comprising overbased alkaline earth metal hydrocarbyl salicylates having a TBN of greater than 300 and an acceptable viscosity.

It would clearly be a desirable object to produce an additive concentrate comprising alkaline earth metal hydrocarbyl-substituted salicylates or sulphurised derivatives thereof having a high TBN, that is a TBN greater than 300, and preferably greater than 350 whilst retaining an acceptable viscosity.

Accordingly the present invention provides a process for the production of a lubricating oil additive concentrate having a TBN greater than 300 which process comprises reacting at elevated temperature component (A) at least one compound which is (i) an alkaline earth metal hydrocarbyl-substituted salicylate, (ii) a hydrocarbyl-substituted salicylic acid, (iii) an alkaline earth metal hydrocarbyl-substituted salicylate and a source of sulphur, (iv) a hydrocarbyl-substituted salicylic acid and a source of sulphur, (v) an alkaline earth metal sulphurised hydrocarbyl-substituted salicylate or (vi) a sulphurised hydrocarbyl-substituted salicylic acid, component (B) an alkaline earth metal base added either in a single addition or in a plurality of additions at intermediate points during the reaction, component (C) at least one compound which is (i) water, (ii) a polyhydric alcohol having 2 to 4 carbon atoms, (iii) a di- ($C_3$ or $C_4$) glycol,(iv) a tri ($C_2$–$C_4$) glycol, (v) a mono- or poly-alkylene glycol alkyl ether of the formula (I)

$$R(OR^1)_xOR^2 \qquad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, component (D) a lubricating oil, component (E) carbon dioxide added subsequent to the, or each, addition of component (B), component (F) sufficient to provide from 2 to 40% by weight, based on the weight of the concentrate, of at least one compound which is (i) a carboxylic acid or an acid anhydride, acid chloride or ester thereof, said acid having the formula (II)

$$R^3-\underset{\underset{R^4}{|}}{CH}-COOH \qquad (II)$$

wherein $R^3$ is a $C_{10}$ to $C_{24}$ alkyl or alkenyl group and $R^4$ is hydrogen, a $C_1$ to $C_4$ alkyl group or a $CH_2COOH$ group, or (ii) a di- or poly-carboxylic acid containing from 36 to 100 carbon atoms or an acid anhydride, acid chloride or ester thereof, and component (G) at least one compound which is (i) an inorganic halide or (ii) an ammonium alkanoate or a mono-, di-, tri- or tetra-alkyl ammonium formate or alkanoate provided that, when component (G) is (ii), component (F) is not an acid chloride, the weight ratios of all components being such as to produce a concentrate having a TBN greater than 300.

Component (A) of the reaction mixture is (i) an alkaline earth metal hydrocarbyl-substituted salicylate, (ii) a hydrocarbyl-substituted salicylic acid, (iii) an alkaline earth metal hydrocarbyl-substituted salicylate and a source of sulphur (iv) a hydrocarbyl-substituted salicylic acid and a source of sulphur, (v) an alkaline earth metal sulphurised hydrocarbyl-substituted salicylate or (vi) a sulphurised hydrocarbyl-substituted salicylic acid, or mixtures of at least two of A(i)–A(vi).

Using component (A) (i) or A(ii) the final product comprises an alkaline earth metal hydrocarbyl-substituted salicylate and using component A (iii), A(iv), A(v) or A(vi) the final product comprises a sulphurised alkaline earth metal hydrocarbyl-substituted salicylate. Suitably the alkaline earth metal may be strontium, calcium, magnesium or barium, preferably calcium, barium or magnesium, more preferably calcium.

Although it is possible to use as a feedstock (A) (ii) a hydrocarbyl-substituted salicylic acid, (A) (iv) a hydrocarbyl-substituted salicylic acid and a source of sulphur, for example elemental sulphur, a sulphur monohalide or a sulphur dihalide, or A (vi) a sulphurised hydrocarbyl-substituted salicylic acid, it is preferred to use either (A)(i), (A)(iii) or, A(v) i.e. to upgrade a pre-formed alkaline earth metal hydrocarbyl-substituted salicylate or sulphurised salicylate. Both the neutral and over-based salicylates may be up-graded in this manner. It is also possible to upgrade a mixture of neutral salicylates and salicylic acids. In this case the salicylates and/or salicylic acids may be sulphurised, or may be mixed with a source of sulphur.

The hydrocarbyl substituent of the hydrocarbyl-substituted salicylate and the hydrocarbyl-substituted salicylic acid and their sulphurised derivatives may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl, radicals derived from the polymerisation of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is either propene, 1-butene or isobutene.

The alkaline earth metal base (component B) may suitably be an alkaline earth metal oxide or hydroxide, preferably the hydroxide. Calcium may be added for example in the form of quick lime (CaO) or in the form of slaked lime ($Ca(OH)_2$). Preferred alkaline earth metals are calcium, magnesium, strontium and barium preferably calcium. The alkaline earth metal base must be added in an amount relative to component (A) sufficient to produce a product having a TBN in excess of 300, preferably in excess of 350. This amount will depend on a number of factors including whether or not component (A) contains any alkaline earth metal base, the nature of the hydrocarbyl-substituent and will be higher than the amounts generally employed in prior art processes. Typically, the weight ratio of component (B) to component (A) may suitably$_7$ be in the range from 0.2 to 50, preferably from 0.4 to 10.

Component (B) may be added in whole to the initial reactants, or in part to the initial reactants and the remainder in one or more portions at a subsequent stage or stages in the process. It is preferred that component (B) is added in a single addition.

As component (C) there may be used one or more polar organic compounds or water, or mixtures thereof; preferably a polar organic compound.

Suitable compounds having the formula (I) include the monomethyl or dimethyl ethers of (a) ethylene glycol, (b) diethylene glycol, (c) triethylene glycol or (d) tetraethylene glycol. A particularly suitable compound is methyl diglycol ($CH_3OCH_2CH_2OCH_2CH_2OH$). Mixtures of glycol ethers of formula (I) and glycols may also be empolyed. Using a glycol ether of formula (I) or a glycol as component (C) it is preferred to use in combination therewith an inorganic halide, for example ammonium chloride, and a lower, i.e. $C_1$ to $C_4$, carboxylic acid, for example acetic acid. The polyhydric alcohol may suitably be either a dihydric alcohol, for example ethylene Elycol or propylene glycol, or a trihydric alcohol, for example glycerol. The di- ($C_3$ or $C_4$) glycol may suitably be dipropylene glycol, the tri- ($C_2$ to $C_4$) glycol may suitably be triethylene glycol. Preferably the component (C) is either ethylene glycol or methyl diglycol, the latter in combination with ammonium chloride and acetic acid.

Component (C), may also suitably be a $C_1$ to $C_{20}$ monohydric alcohol, a $C_1$ to $C_{20}$ ketone, a $C_1$ to $C_{10}$ carboxylic acid ester or a $C_1$ to $C_{20}$ ether which may be aliphatic, alicyclic or aromatic. Examples are methanol, acetone, 2-ethyl hexanol, cyclohexanol, cyclohexanone, benzyl alcohol, ethyl acetate and acetophenone, preferably 2-ethyl hexanol. In the preferred method of producing the concentrate of the present invention, there may be used in combination (i) component (C) as defined above and (ii) a solvent.

As the solvent (ii) there may suitably be used an inert hydrocarbon, which may be aliphatic or aromatic. Examples of suitable solvents (ii) include toluene, xylene, naphtha and aliphatic paraffins, for example hexane, and cycloaliphatic paraffins.

A particularly preferred combination of (i) and (ii) is methanol and toluene. An advantage of using a combination of (i) and (ii) is that the use of ethylene glycol can be avoided. Residual ethylene glycol in the lubricating oil additive may result in corrosion of an engine in which the concentrate is used.

Component (D) is a lubricating oil. The lubricating oil is suitably an animal, vegetable or mineral oil. Suitably the lubricating oil is a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tri-decyladipate, or polymeric hydrocarbon lubricating oils, for example liquid polyisobutenes and poly-alpha olefins. The lubricating oil may suitably comprise from 10 to 90%, preferably from 10 to 70%, by weight of the concentrate.

Component (E) is carbon dioxide, which may be added in the form of a gas or a solid, preferably in the form of a gas. In gaseous form it may suitably be blown through the reaction mixture. We have found that generally the amount of carbon dioxide incorporated increases with increasing concentrations of component (F).

Suitably carbon dioxide in a combined form may be present in the concentrate in an amount in the range from 5 to 20, preferably from 9 to 15% by weight based on the weight of the concentrate.

Component (F) is either (i) a carboxylic acid of formula (II), or (ii) a di- or polycarboxylic acid containing from 36 to 100 carbon atoms, or an acid anhydride, an acid chloride or ester of (i) or (ii). As regards (i), this is a carboxylic acid having the formula (II) or an acid anhydride, acid chloride or ester thereof. Preferably $R^3$ is an unbranched alkyl or alkenyl group. Preferred acids of formula (II) are those wherein $R^4$ is hydrogen and $R^3$ is a $C_{10}$ to $C_{24}$, more preferably $C_{18}$ to $C_{24}$ unbranched alkyl group. Examples of suitable saturated carboxylic acids of formula (II) include capric, lauric, myristic, palmitic, stearic, isostearic, arachidic, behenic and lignoceric acids. Examples of suitable unsaturated acids of formula (II) include lauroleic, myristoleic, palmitoleic, oleic, gadoleic, erucic, ricinoleic, linoleic and linolenic acids. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example tall, cotton, ground nut, coconut, linseed, palm kernel,olive, corn, palm, castor, soyabean, sunflower, herring and sardine oils and tallow. Sulphurised acids and acid mixtures may also be employed. Instead of, or in addition to, the carboxylic acid there may be used the acid anhydride, the acid chloride or the ester derivatives of the acid, preferably the acid anhydride. It is preferred however to use a carboxylic acid or a mixture of carboxylic acids. A preferred carboxylic acid of formula (II) is stearic acid.

Instead of, or in addition to (i), component (F) may be (ii) a di- or polycarboxylic acid containing from 36 to 100 carbon atoms or an acid anhydride, acid chloride or ester derivative thereof, preferably an acid anhydride thereof; (ii) is preferably a polyisobutene succinic acid or a polyisobutene succinic anhydride.

Suitably the concentrate may have a viscosity measured at 100° C. of less than 1000 cSt, preferably less than 750 cSt, more preferably less than 500 cSt.

The amount of component (F) required to provide from 2 to 40% by weight based on the weight of the concentrate will be to a first approximation the amount desired in the concentrate. In calculating this amount allowance should be made for loss of water from carboxylic acids, for example.

The reaction is carried out in the presence of component (G). As component (G) there may be used (i) an inorganic halide which may suitably be either a hydrogen, an ammonium or a metal halide. Suitably the metal moiety of the metal halide may be zinc, aluminium or an alkaline earth metal, preferably calcium. Of the halides, the chloride is preferred. Suitable chlorides include hydrogen chloride, calcium chloride, ammonium chloride, aluminium chloride and zinc chloride, preferably calcium chloride.

Alternatively, component (G) may be (ii) an ammonium alkanoate or a mono-, di-, tri- or tetra-alkyl ammonium formate or alkanoate, preferably an ammonium alkanoate, more preferably ammonium acetate.

Component (G) may be mixture of (i) and (ii). However, when component (G) is (ii) above, component (F) is not an acid chloride.

Suitably the amount of component (G) employed may be up to 2.0% by weight based on the weight of the concentrate.

Typically, the amount of component (F) incorporated is 10% to 35%, more preferably 12 to 20%, for example about 16% by weight based on the weight of the concentrate.

Suitably the amount of total alkaline earth metal present in the concentrate is 10 to 20% by weight based on the weight of the concentrate.

The alkaline earth metal hydrocarbyl-substituted salicylate in the final product may be either sulphurised or non-sulphurised, preferably non-sulphurised. Where it is sulphurised, sulphur may be present in the concentrate in an amount of 1 to 6%, preferably 1.5 to 3% by weight based on the weight of the concentrate.

Preferably the TBN of the concentrate is greater than 350, more preferably greater than 400.

Suitably the reaction of components (A)–(G) may be carried out from 15 to 200, preferably 60°to 150° C., though the actual temperatures chosen for various stages of the reaction may differ if desired. The pressure may be atmospheric, subatmospheric or superatmospheric.

The concentrate may be recovered by conventional means, for example by distillative stripping of component (C), or the solvent (if any).

Finally, it is preferred to filter the concentrate so-obtained. Generally, the process of the invention will produce a concentrate having an acceptable viscosity, that is a viscosity of less than 1000 cSt at 100° C., and can produce concentrates having a viscosity less than 750 or 500 cSt at 100° C. Such viscometric properties are advantageous because they facilitate processing (including filtration) of the concentrate. However, it is also possible to produce concentrates having a higher viscosity than 1000 cSt at 100° C., generally at higher TBN levels. Filtration of such concentrates presents a problem, which may be overcome by adding a diluent prior to filtration and stripping the diluent off after filtration. Alternatively, high viscosity concentrates, for example concentrates having a viscosity at 100° C. greater than 1000 cSt, and also having a high TBN, for example greater than 350, may be diluted by addition of further lubricating oil whilst maintaining a TBN greater than 300, thereby facilitating filtration.

Alternatively, the concentrate can be centrifuged in the presence of a diluent.

A final aspect of the present invention provides a finished lubricating oil composition which composition comprises a lubricating oil and lubricating oil additive concentrate prepared as herein before described, Preferably the finished lubricating oil composition contains sufficient of the additive concentrate to provide a TBN of from 0.5 to 120.

The amount of additive concentrate present in the finished lubricating oil will depend on the nature of the final use. Thus, for marine lubricating oils the amount of additive concentrate present may suitably be sufficient to provide a TBN of 9 to 100 and for automobile engine lubricating oils the amount may suitably be sufficient to provide a TBN of 4 to 20.

The finished lubricating oil composition may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the concentrate composition.

In addition to their use as additives for incorporation into lubricating oil compositions, the additive concentrate of the present invention may also find application as fuel additives.

The invention will now be further illustrated by reference to the following Examples. In all the Examples the term "TBN" (Total Base Number) is used. TBN is expressed in mg KOH/g as measured by the method of ASTM D2896. In the examples where lime is used, it is in the form of slaked lime $Ca(OH)_2$. Viscosities were measured by the method of ASTM D445.

EXAMPLE 1

| Charge: | |
|---|---|
| OSCA 420 (an overbased commercially available salicylate: 280 TBN; ex. OSCA Chemical Co. Japan) | 230 g |
| Lubricating oil (100 SN) | 26 g |
| Calcium chloride | 3 g |

Method (a) The charge was heated to 100° C. and stearic acid (63 g) was added at 100° C.,
(b) 2-ethylhexanol (190 g) was added at 100° C.,
(c) Lime (66 E) was added at 120° C./700 mmHg,
(d) The mixture was heated to 145° C./500 mmHg. Ethylene glycol (32 g) was added at 145° C./500 mmHg over 20 minutes,
(e) The mixture was held at 145° C./500 mmHg for 5 minutes,
(f) Carbon dioxide (56 g) was added at 145° C./1 bar,
(g) The product was stripped at 200° C./10 mmHg,
(h) The product was filtered.

| Product Weights | |
|---|---|
| Crude product | 369 g |
| Distillate | 235 g |
| **Product Composition After Filtration** | |
| Calcium | 14.22% w/w |
| $CO_2$ | 11.1% w/w |
| TBN | 407 mg KOH/g |
| $V_{100}$ | 880 cSt |
| $V_{40}$ | 18950 cSt |
| VI | 236 |

EXAMPLE 2

| Charge: | |
|---|---|
| OSCA 405 (an overbased commercially available salicylate: 175 TBN; ex. OSCA Chemical Co., Japan) | 230 g |
| Lubricating oil (100 SN) | Zero |
| Calcium chloride | 4.0 g |

Method

Step (a) to (g) of Example 1 was repeated except that:
in step (c) instead of 66 g lime there was used 76 g,
in step (d) instead of 32 g ethylene glycol there was used 37 g and it was added over 5 minutes instead of 20 minutes,
in step (f) instead of 56 g carbon dioxide there was used 76 g, and an extra step was added as follows:
(h) Lubricating oil (100 SN) (20 g) was added.

| Product Weights | |
|---|---|
| Crude product | not determined |
| Distillate | 222 g |

-continued

| Product Composition After Filtration | |
|---|---|
| Calcium | 13.3% w/w |
| $CO_2$ | 13.4% w/w |
| TBN | 372 mg KOH/g |
| $V_{100}$ | 414 cSt |
| $V_{40}$ | 6625 cSt |
| VI | 220 |

EXAMPLE 3

| Charge: | |
|---|---|
| OSCA 420 (280 TBN, ex OSCA Chemical Co., Japan) | 236 g |
| Lubricating oil (100 SN) | 27 g |
| Calcium chloride | 3 g |

Method (a) The mixture was heated to 100° C. and stearic acid (65 g) was added at 100° C.,
(b) 2-Ethylhexanol (299 g) was added at 100° C.,
(c) Lime (68 g) was added at 120° C./700 mmHg,
(d) The mixture was heated to 135° C./500 mmHg. Ethylene glycol (33 g) was added at 135° C./500 mmHg over a period of 5 minutes,
(e) The mixture was held at 135° C./500 mmHg for 5 minutes,
(f) Carbon dioxide (56 g) was added at 135° C./1 bar,
(g) The product was stripped at 200° C./10 mmHg,
(h) Lubricating oil (SN 100) (20 g) was added,
(i) The product was filtered.

| Product Weights | |
|---|---|
| Crude product | 395 g |
| Distillate | 238 g |
| **Product Composition After Filtration** | |
| Calcium | 13.16% w/w |
| $CO_2$ | 10.5% w/w |
| TBN | 395 mg KOH/g |
| $V_{100}$ | 205 cSt |
| $V_{40}$ | 4012 cSt |
| VI | 163 |

EXAMPLE 4

| Charge: | |
|---|---|
| OSCA 420 (280 TBN, ex OSCA Chemical Co., Japan) | 230 g |
| Lubricating oil (100 SN) | 26 g |
| Ammonium chloride | 3 g |

Method (a) The mixture was heated to 100° C. and stearic acid (63 g) added at 100° C.,
(b) Methyldiglycol (130 g) and acetic acid (2.0 g) were added at 100° C.,
(c) Lime (60 g) was added at 120° C./700 mmHg,
(d) The mixture was heated to 135° C./500 mmHg,
(e) The mixture was held at 135° C./500 mmHg for 5 minutes,
(f) Carbon dioxide (56 g) was added at 135° C./1 bar,
(g) The product was stripped at 200° C./10 mmHg, and
(h) The product was filtered.

| Product Weights | |
|---|---|
| Crude product | 443 g |
| Distillate | 132 g |
| **Product Composition After Filtration** | |
| Calcium | 13.4% w/w |
| $CO_2$ | 14.1% w/w |
| TBN | 339 mg KOH/g |
| $V_{100}$ | 315 cSt |
| $V_{40}$ | 5329 cSt |
| VI | 199 |

EXAMPLE 5

| Charge: | |
|---|---|
| Shell AC 60C (an overbased commercially available salicylate; ex Shell Chemicals Ltd. 174 TBN; 5.9% w/w Ca; 0.4% w/wS; $V_{100}$ 24cSt; V40 208cSt; VI (143) | 263 g |
| Lime | 49 g |
| Stearic acid | 70 g |
| Calcium chloride | 4 g |
| 2-Ethylhexanol | 112 g |

Method (a) The mixture was heated from 145° C. to 165° C./700 mmHg whilst adding ethylene glycol (36 g).
(b) The mixture was held for one hour at 165° C./700 mmHg,
(c) Carbon dioxide (50 g) was added at 165° C./1 bar,
(d) The mixture was cooled to 135° C./700 mmHg and lime (33 g) was added,
(e) The mixture was reacted at 165° C./700 mmHg for one hour,
(f) Carbon dioxide (25 g) was added,
(g) The product was stripped at 210° C./10 mmHg, and
(h) The product was filtered to give 473 g product.

| Product Composition After Filtration | |
|---|---|
| Calcium | 12.0% w/w |
| S | 0.3% w/w |
| $CO_2$ | 11.8% w/w |
| TBN | 335 mg KOH/g |
| $V_{100}$ | 154 cSt |
| $V_{40}$ | 2008 cSt |
| VI | 186 |

EXAMPLE 6

| Charge: | |
|---|---|
| OSCA 420 (see Example 1) | 230.0 g |
| Stearic acid (70% pure) | 63.0 g |
| Lubricating oil (SN 130) | 26.0 g |
| Calcium chloride | 3.0 g |
| Toluene | 240.0 g |
| Methanol | 20.0 g |

Method (a) The mixture was heated to 60° C. and reacted at this temperature,
(b) Lime (66.0 g) was added at 60° C./700 mmHg,
(c) Carbon dioxide (35 g) was added at 60° C.,
(d) The mixture was stripped at 130° C./10 mmHg for 60 minutes, and
(e) The product was filtered.

| Product Weights | |
|---|---|
| Crude Product = | 350.5 g |
| Distillate = | 185.3 g |
| **Product Composition After Filtration** | |
| Calcium | 14.6% w/w |
| Carbon Dioxide | 13.9% w/w |
| TBN | 408 mg KOH/g |
| $V_{100}$ | 678 cSt |
| $V_{40}$ | not determined |
| Stearic acid | 18.0% w/w |

EXAMPLE 7

| Charge: | |
|---|---|
| OSCA 420 (an overbased commercially available salicylate: 280 TBN; ex. OSCA Chemical Co. Japan) | 230 g |
| Lubricating oil (100 SN) | 26 g |
| Ammonium Acetate | 3 g |

Method (a) The charge was heated to 100° C. and stearic acid (63g) was added at 100° C.,
(b) 2-ethylhexanol (190g) was added at 100° C.,
(c) Lime (66 g) was added to 120° C./700 mmHg,
(d) The mixture was heated to 145° C./500 mmHg. Ethylene glycol (32 g) was added at 145° C./500 mmHg over 20 minutes,
(e) The mixture was held at 145° C./500 mmHg for 5 minutes,
(f) Carbon dioxide (56 g) was added at 145° C./1 bar,
(g) The product was stripped at 200° C./10 mmHg,
(h) The product was filtered.

| Product Weights | |
|---|---|
| Crude product | 443 g |
| **Product Composition After Filtration** | |
| Calcium | 13.4% w/w |
| TBN | 339 mg KOH/g |
| $v_{100}$ | 315 cSt |
| $v_{40}$ | 5329 cSt |

OSCA and Shell are Trade Names.

We claim:

1. A process for the production of a lubricating oil additive concentrate having a TBN greater than 300 which process comprises reacting at a temperature in the range 15°–200° C.

component (A) at least one compound selected from the group consisting of (i) an alkaline earth metal hydrocarbyl-substituted salicylate, (ii) a hydrocarbyl-substituted salicylic acid, (iii) an alkaline earth metal hydrocarbyl-substituted salicylate and a source of sulphur, (iv) a hydrocarbyl-substituted salicylic acid and a source of sulphur, (v) an alkaline earth metal sulphurised hydrocarbyl-substituted salicylate and (vi) a sulphurised hydrocarbyl-substituted salicylic acid, component (B) an alkaline earth metal base, component (C) at least one compound selected from the group consisting of (i) water, (ii) a polyhydric alcohol having 2 to 4 carbon atoms, (iii) a di- $C_3$ or $C_4$glycol, (iv) a tri- ($C_2$–$C_4$) glycol, (iv) a mono- or poly-alkylene glycol alkyl ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, and (ix) a $C_1$ to $C_{20}$ ether, component (D) a lubricating oil, component (E) carbon dioxide, component (F) sufficient to provide from 2 to 40% by weight, based on the weight of the concentrate, of at least one compound selected from the group consisting of (i) a carboxylic acid or an acid anhydride, or ester thereof, said acid having the formula (II)

$$R^3-\underset{\underset{R^4}{|}}{CH}-COOH \quad (II)$$

wherein $R^3$ is a $C_{10}$ to $C_{24}$ alkyl or alkenyl group and $R^4$ is hydrogen, a $C_1$ to $C_4$ alkyl group or a $CH_2COOH$ group, and (ii) a di- or poly-carboxylic acid containing from 36 to 100 carbon atoms or an acid anhydride, acid chloride or ester thereof, and component (G) which is an ammonium alkanoate or a mono-, di-, tri- or tetra-alkyl ammonium formate or alkanoate, the weight ratios of all components being such as to produce a concentrate having a TBN greater than 300.

2. A process as claimed in claim 1 wherein component (A) is at least one compound selected from the group consisting of (i), (iii) or (v).

3. A process as claimed in claim 1 wherein said ammonium alkanoate is ammonium acetate.

4. A process as claimed in claim 1 wherein component (C) is a mono- or poly-alkylene glycol alkyl ether of the formula (I) as defined in claim 1 and said process is carried out in the presence of a $C_1$–$C_4$ carboxylic acid.

5. A process as claimed in claim 4 wherein component (C) is methyl diglycol, and said $C_1$–$C_4$ carboxylic acid is acetic acid.

6. A process as claimed in claim 1 wherein said lubricating oil additive concentrate has a viscosity at 100° C. of less than 1000 cSt.

7. A process as claimed in claim 1 wherein component (A) is (i), component (B) is calcium hydroxide, component (C) is a compound selected from the group consisting of ethylene glycol, methanol and 2 ethyl hexanol, component (F) is stearic acid component (G) is ammonium acetate.

8. A process as claimed in claim 1, wherein Component (A) is prereacted with Components (C) and (F) prior to the addition of Components (B) and (E).

9. A process as defined in claim 8, wherein Component (A) is an overbased alkaline earth metal hydrocarbyl-substituted salicylate and Component (F) is stearic acid.

* * * * *

UNITED STATES PATENT AND TRADEMARK OFFICE

CERTIFICATE OF CORRECTION

PATENT NO. : 5,451,331
DATED : September 19, 1995
INVENTOR(S) : Sean P. O'Connor, et. al.

It is certified that error appears in the above-indentified patent and that said Letters Patent is hereby corrected as shown below:

Title page, item [57] Abstract: line 18, insert--a space between "$C_{20}$ and ether"

Column 4, line 13, after "ethylene" the word Elycol" should be--glycol --.

Column 7, line 23, after "Lime" change "(66E)" to -- (66g) --.

Column 10, claim 1, line 19, insert--a space between "$C_4$ and glycol"

Signed and Sealed this

Thirtieth Day of January, 1996

Bruce Lehman

*Attest:*

BRUCE LEHMAN

*Attesting Officer*

*Commissioner of Patents and Trademarks*